US007985923B2

(12) United States Patent
Yagi et al.

(10) Patent No.: US 7,985,923 B2
(45) Date of Patent: Jul. 26, 2011

(54) TERMINAL CRIMPING STRUCTURE AND TERMINAL CRIMPING METHOD OF CRIMPING TERMINAL TO COPPER ALLOY WIRE AND WIRE HARNESS WITH THE TERMINAL CRIMPING STRUCTURE

(75) Inventors: Satoshi Yagi, Makinohara (JP); Shigeharu Suzuki, Makinohara (JP); Tetsuro Ide, Makinohara (JP); Hideto Kumakura, Makinohara (JP); Kenji Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 713 days.

(21) Appl. No.: 11/969,964

(22) Filed: Jan. 7, 2008

(65) Prior Publication Data

US 2008/0172874 A1 Jul. 24, 2008

(30) Foreign Application Priority Data

Jan. 23, 2007 (JP) ..... 2007-013058

(51) Int. Cl.
*H01R 4/00* (2006.01)

(52) U.S. Cl. ..... 174/84 R; 174/84 C

(58) Field of Classification Search ..... 174/74 R, 174/78, 84 R, 84 C; 439/98, 877, 882
See application file for complete search history.

(56) References Cited

U.S. PATENT DOCUMENTS 2,818,632 A * 1/1958 Hammell ..... 29/865
3,146,519 A * 9/1964 Redwine ..... 29/862
3,510,829 A * 5/1970 Keller ..... 439/421

FOREIGN PATENT DOCUMENTS

JP 3005065 U 9/1994

* cited by examiner

*Primary Examiner* — William H Mayo, III
(74) *Attorney, Agent, or Firm* — Sughrue Mion, PLLC

(57) ABSTRACT

A terminal crimping structure includes a terminal crimped to a copper alloy wire. The terminal has a crimping piece portion crimped to the copper alloy core wire portion. A rate of compression of the copper alloy core wire portion, of a particular diameter, by the crimping piece portion is determined from a relative relation between a parameter varying according to the ratio of (the cross-sectional area of the copper alloy core wire portion at a crimped portion)/(the cross-sectional area of the copper alloy core wire portion before crimping) and a parameter varying according to the ratio of (a cross-sectional area of an annealed copper core wire portion at a crimped portion)/the cross-sectional area of the annealed copper core wire portion before crimping) which is the rate of compression of the annealed copper core wire portion by the crimping piece portion.

4 Claims, 9 Drawing Sheets

TERMINAL CRIMPING STRUCTURE AND TERMINAL CRIMPING METHOD OF CRIMPING TERMINAL TO COPPER ALLOY WIRE AND WIRE HARNESS WITH THE TERMINAL CRIMPING STRUCTURE

BACKGROUND

This invention relates to a terminal crimping structure and a terminal crimping method in which a metal terminal having a pair of crimping piece portions extending upwardly respectively from opposite side edges of a base plate portion thereof is crimped (press-clamped) to a copper alloy wire of an electric wire, and the invention also relates to a wire harness having this terminal crimping structure.

For example, there is known one related metal terminal in which a compression rate A {=(a cross-sectional area of that portion of a conductor surrounded by crimping piece portions/a cross-sectional area of the conductor before crimping) which is the ratio of (the cross-sectional area of the conductor after crimping)/(the cross-sectional area of the conductor before crimping) is set to 80% to 85% (see, for example, JP-UM-A-3005065).

Usually, core wires of electric wires are different in the value of a strain in an initial condition before crimping, depending on their material and processing. And besides, even when the cores wires are subjected to the same compression, the core wires are different in the amount of change of a tensile strength per unit area. Therefore, the compression rate need to be determined taking the material and processing of the core wire of the electric wire into consideration.

In the JP-UM-A-3005065, however, the compression rate is not determined taking the material and processing of the core wire of the electric wire into consideration, and therefore it is difficult to secure a desired mechanical performance and a desired electrical performance.

SUMMARY

This invention has been made in view of the above circumstances, and an object of the invention is to provide a structure and a method of crimping a terminal to a copper alloy wire, in which a required mechanical performance and a required electrical performance can be secured. Another object of the invention is to provide a wire harness having this terminal crimping structure.

1) According to one aspect of the present invention, there is provided a terminal crimping structure, comprising:

a terminal that is crimped to a copper alloy wire of an electric wire which has a copper alloy core wire portion composed of a copper alloy wire element and a sheath portion covering the copper alloy core wire portion, wherein the terminal has a crimping piece portion crimped to the copper alloy core wire portion;

wherein in the case where a cross-sectional area of the copper alloy core wire portion is 0.08 $mm^2$ to 0.13 $mm^2$, a rate of compression of the copper alloy core wire portion by the crimping piece portion is determined from a relative relation between a parameter varying according to the ratio of (the cross-sectional area of the copper alloy core wire portion at a crimped portion)/(the cross-sectional area of the copper alloy core wire portion before crimping) and a parameter varying according to the ratio of (a cross-sectional area of an annealed copper core wire portion at a crimped portion)/the cross-sectional area of the annealed copper core wire portion before crimping) which is the rate of compression of the annealed copper core wire portion by the crimping piece portion.

2) Preferably, the rate of compression of the copper alloy core wire portion is determined such that a wire clamping force of the copper alloy wire varying according to the compression rate of the copper alloy core wire portion is greater than a wire clamping force of the annealed copper wire varying according to the compression rate of the annealed copper core wire portion.

3) According to another aspect of the invention, there is provided a terminal crimping structure, comprising:

a terminal that is crimped to a copper alloy wire of an electric wire which has a copper alloy core wire portion composed of a copper alloy wire element and a sheath portion covering the copper alloy core wire portion, wherein the terminal has a crimping piece portion crimped to the copper alloy core wire portion;

wherein in the case where a cross-sectional area of the copper alloy core wire portion is 0.08 $mm^2$ to 0.13 $mm^2$, a rate of compression of the copper alloy core wire portion by the crimping piece portion is fell in a range of from about 85% to about 95%; and wherein the rate of compression of the copper alloy core wire portion by the crimping piece portion is expressed as a ratio of (the cross-sectional area of the copper alloy core wire portion at a crimped portion)/(the cross-sectional area of the copper alloy core wire portion before crimping).

4) According to a further aspect of the invention, there is provided a wire harness, comprising:

an electric wire that has a copper alloy core wire portion composed of a copper alloy wire element and a sheath portion covering the copper alloy core wire portion; and a terminal that is crimped to a copper alloy core wire of the electric wire, wherein the terminal has a crimping piece portion crimped to the copper alloy core wire portion;

wherein in the case where a cross-sectional area of the copper alloy core wire portion is 0.08 $mm^2$ to 0.13 $mm^2$, a is fell in the range of from about 85% to about 95%; and wherein a rate of compression of the copper alloy core wire portion by the crimping piece portion is expressed as a ratio of (the cross-sectional area of the copper alloy core wire portion at a crimped portion)/(the cross-sectional area of the copper alloy core wire portion before crimping).

5) According to a further aspect to the invention, there is provided a method of crimping a terminal to a copper alloy wire of an electric wire which has a copper alloy core wire portion composed of a copper alloy wire element and a sheath portion covering the copper alloy core wire portion, the method comprising:

providing the terminal having a crimping piece portion for crimping the copper alloy core wire portion; and crimping the terminal to the copper alloy wire based on a compression rate of the copper alloy core wire portion by the crimping piece portion, wherein the compression rate of the copper alloy core wire portion by the crimping piece portion is determined from the relative relation between a parameter varying according to the ratio of (the cross-sectional area of the copper alloy core wire portion at a crimped portion)/(the cross-sectional area of the copper alloy core wire portion before crimping) which is the rate of compression of the copper alloy core wire portion by the crimping piece portion and a parameter varying according to the ratio of (a cross-sectional area of an annealed copper core wire portion at a crimped portion)/the cross-sectional area of the annealed copper core wire portion before crimping) which is the rate of compression of the annealed copper core wire portion by the crimping piece portion in the case where a cross-sectional area of the copper alloy core wire portion is 0.08 $mm^2$ to 0.13 $mm^2$ 6) Preferably, the compression rate of the copper alloy core wire portion is determined in such a range that a wire clamping force varying according to the compression rate of the copper alloy core wire portion is greater than a wire clamping force varying according to the compression rate of the annealed copper core wire portion.

7) According to a further aspect of the invention, there is provided a method of crimping a terminal to a copper alloy wire of an electric wire which has a copper alloy core wire portion composed of a copper alloy wire element and a sheath portion covering the copper alloy core wire portion, the method comprising:

providing the terminal having a crimping piece portion for crimping the copper alloy core wire portion; and crimping the terminal to the copper alloy wire so that a compression rate of the copper alloy core wire portion by the crimping piece portion is fell in a range of from about 85% to about 95%, wherein the rate of compression of the copper alloy core wire portion is expressed as the ratio of (the cross-sectional area of the copper alloy core wire portion at a crimped portion)/(the cross-sectional area of the copper alloy core wire portion before crimping), in the case where a cross-sectional area of the copper alloy core wire portion is 0.08 $mm^2$ to 0.13 $mm^2$.

In the structure and method of the invention for crimping the terminal to the copper alloy wire, the compression rate is determined taking the material and processing of the core wire of the wire into consideration, and therefore there can be provided the structure and the method of crimping the terminal to the copper alloy wire and also the wire harness having the terminal crimping structure, in which the required mechanical performance and electrical performance can be secured.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A preferred embodiment of the present invention will now be described with reference to the drawings.

Figure 1:
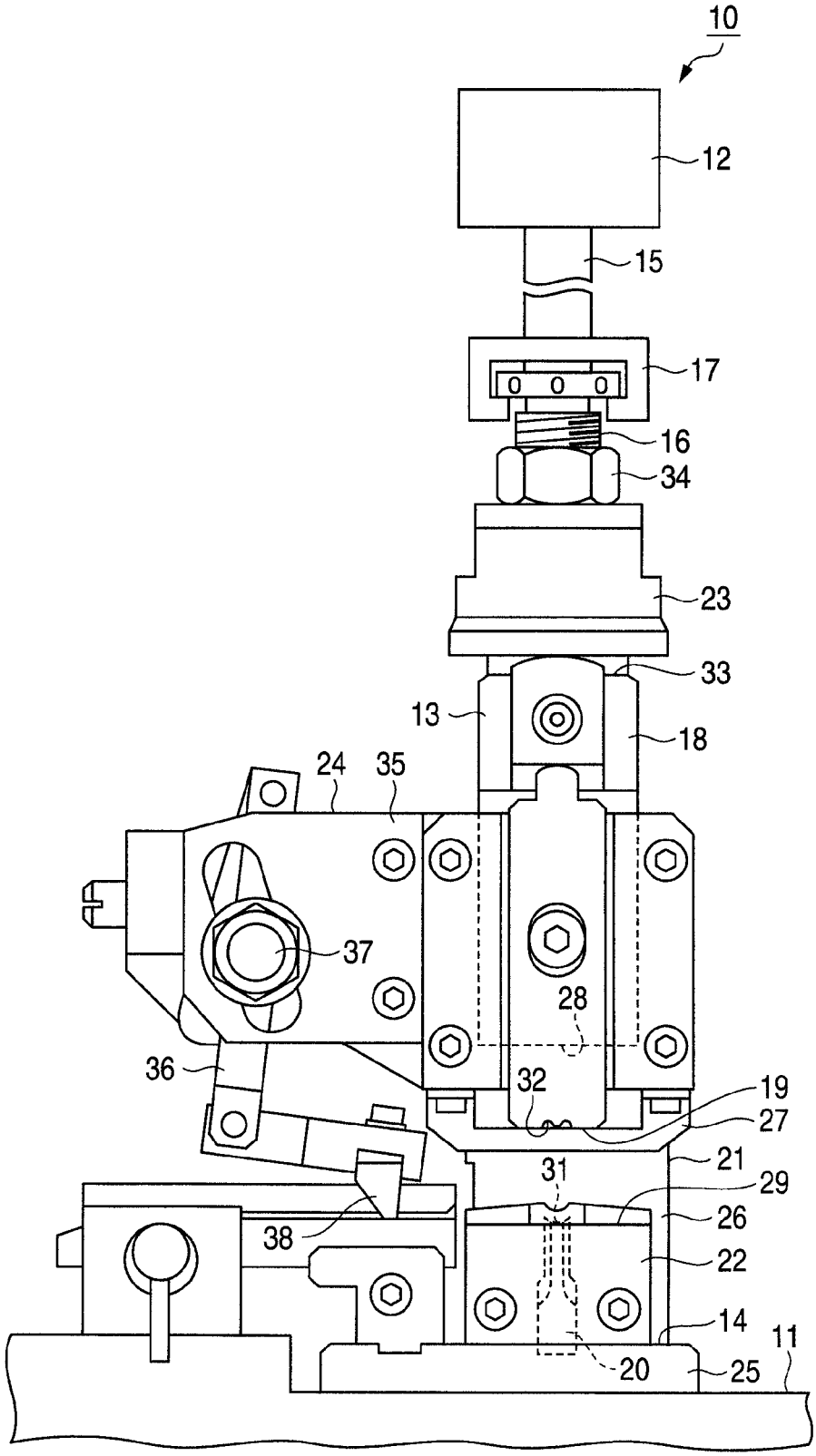
FIG. 1 is a front-elevational view of one preferred embodiment of a crimping machine of the present invention.
Figure 2:
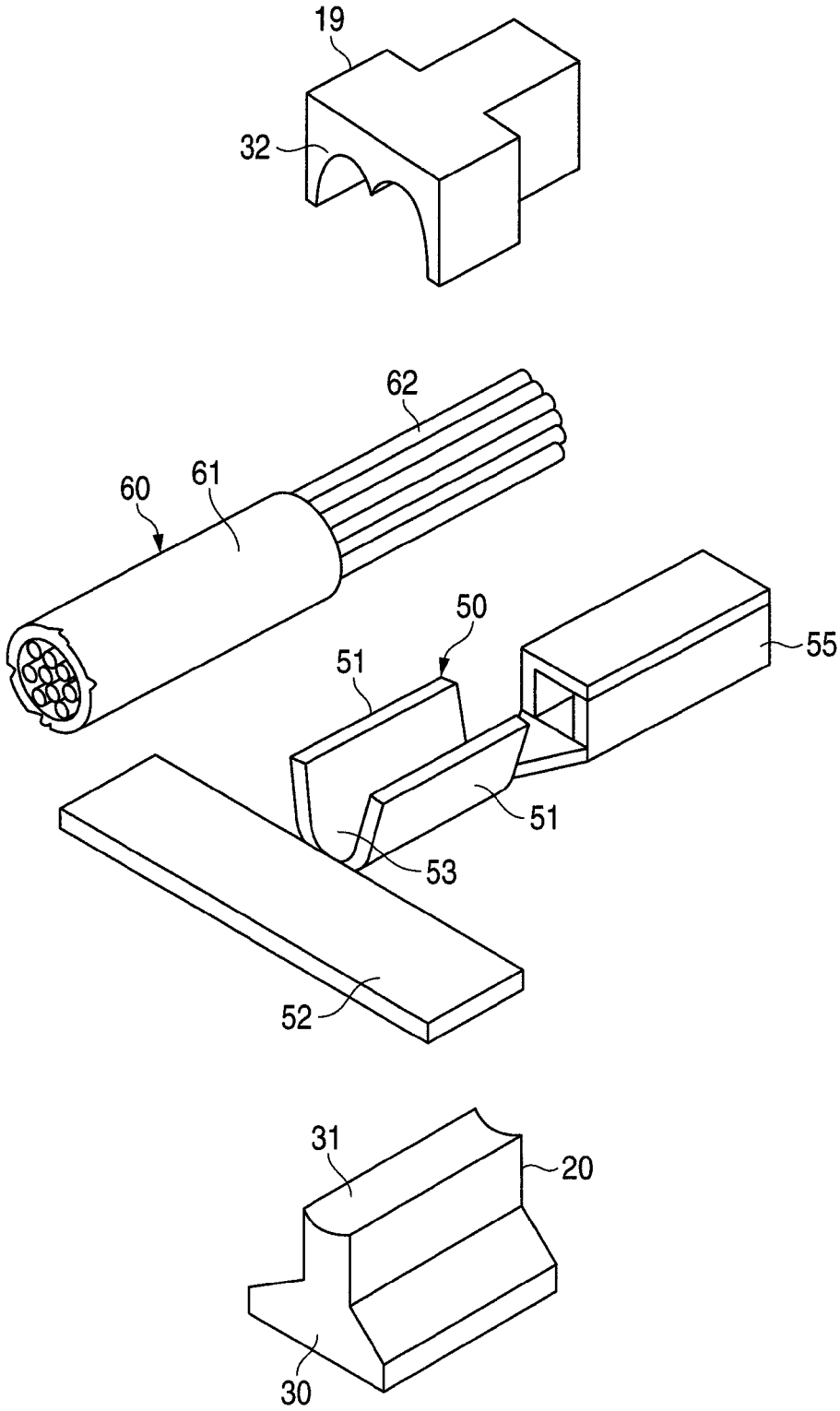
FIG. 2 is a perspective view showing a crimper, an anvil and a metal terminal used in the crimping machine of FIG. 1.

As shown in FIGS. 1 and 2, the crimping machine 10 of the invention includes a base 11 placed on a floor or the like, a drive source 12, and a crimping applicator 13 for crimpingly connecting the metal terminal 50 to an electric wire 60.

The base 11 has a flat portion 14 which is generally flat in a horizontal direction. The crimping applicator 13 is placed and supported on the base 11.

The drive source 12 includes a servomotor (not shown), a drive shaft 15 for transmitting a driving force, and a hook 17 engaged with a disk portion (not shown) of a shank 16. A rotational motion of the servomotor is converted into a linear motion via a piston-crank mechanism so as to move a ram 18 upward and downward. Instead of the servomotor, a hydraulic cylinder having a piston rod connected to the shank 16 in directly-driving relation or other suitable drive device may be used.

The crimping applicator 13 includes the crimper 19, and the anvil 20. The crimper 19 is moved downward to press-deform core wire-crimping piece portions 51 of the metal terminal 50, thereby crimping the crimping piece portions 51 to the core wire 62 of the electric wire 60.

Various forms of metal terminals can be used as the metal terminal 50 which is to be press-deformed by the crimping applicator 13. For example, a female metal terminal having a box-like electrical contact portion, a male terminal having a tab-like electrical contact portion, a joint metal terminal for connecting two wires together, etc., can be used.

The metal terminal 50 is formed by blanking a piece of a predetermined shape from an electrically-conductive sheet and then by bending this piece into a required shape. The metal terminal 50 includes a sheath clamping (crimping) piece portion 52 adapted to be press-clamped to a sheath 61 of the electric wire 60 (forming a main wire portion of a wire harness or one of a plurality of branch wire portions branching off from this main wire portion) at an end portion thereof, a curved base plate portion 53 on which that portion of the core wire 62 of the electric wire 60 from which the sheath 61 has been removed is adapted to be placed, the pair of core wire-crimping piece portions 51 extending upwardly respectively from opposite side edges of the base plate portion 53, and a box-like electrical contact portion 55 having therein a contact piece for electrical contact with a mating terminal.

The core wire 62 of the electric wire 60 is extremely thin, and has a diameter, for example, of about 0.13 $mm^2$ to about 0.08 $mm^2$, and there are two types of core wires 62, that is, an annealed copper wire plated with tin or nickel and a copper alloy wire.

Figure 3:
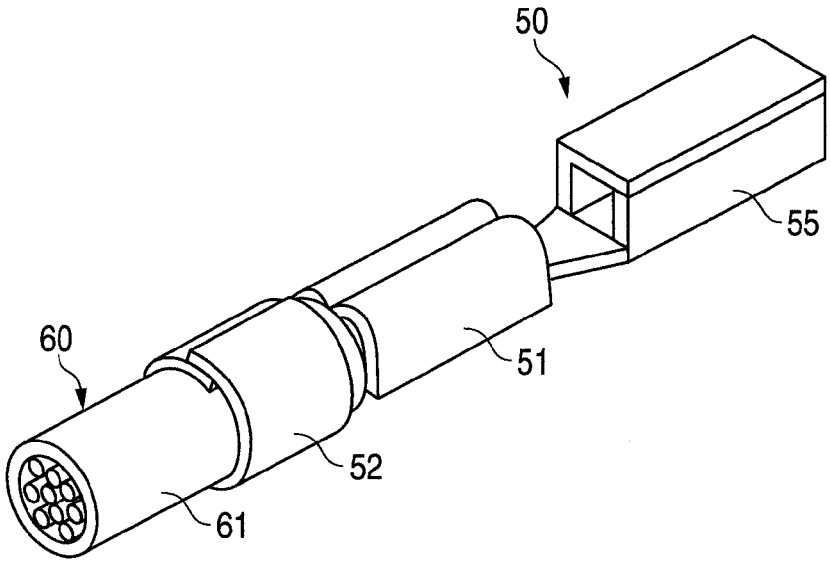
FIG. 3 is a perspective view showing the metal terminal of FIG. 2 in its compressed condition.

The pair of core wire-crimping piece portions 51 of the metal terminal 50 are press-deformed or bent inwardly by the downward movement of the crimper 19, and therefore are crimped to the core wire 62 of the electric wire 60 to be electrically connected thereto (see FIG. 3).

A rotational motion of the servomotor is converted into a linear motion by the piston/crank mechanism so as to move the ram 18 (holding the crimper 19) upward and downward, thereby moving the crimper 19 upward and downward. There is provided a control portion (not shown) for controlling the upward and downward movement of the ram 18, and this control portion effects various controls including the acceleration, deceleration, crimping movement and standing-by of the ram 18.

The crimping applicator 13 includes a frame 21, a holder 22 having the anvil 20, the ram 18 supported on the frame 21, a ram bolt 23, a ram bolt 23 threadedly engaged with the ram 18 so as to enable the upward and downward movement of the ram 18, the shank 16 threadedly engaged with the ram bolt 23, and a terminal feed unit 24.

The frame 21, when viewed from the side thereof, has a generally recumbent U-shape, and includes a mounting portion 25 on which the holder 22 is mounted, an upwardly-extending support post portion 26, and a ram support portion 27.

The frame 21 is placed on the flat portion 14 of the base 11, and is fixed thereto to bolts and nuts (not shown). The frame 21 may be integrally fixed to the base 11.

The ram support portion 27 is connected to an upper end portion of the support post portion 26 extending upwardly from the mounting portion 25 on which the holder 22 is mounted. A space for guiding the ram 18 is formed in the ram support portion 27, and the ram 18 is slidably fitted in this space.

The anvil 20 for the placing of the metal terminal 50 thereon is embedded in the holder 22. The holder 22 has a flat surface 29 opposed to both of the crimper 19 and a lower end surface 28 of the ram 18. Namely, the flat surface 29 is disposed substantially perpendicularly to both of the direction of movement of the ram 18 and a direction of movement of the crimper 19.

The anvil 20 is received and held in the holder 22, and in this condition the holder 22 is mounted on the mounting portion 25 of the frame 21. The anvil 20 is held in the holder 22, with its bottom plate 30 disposed in intimate contact with a bottom wall of the holder 22, and therefore the anvil 20 can support the metal terminal 50 thereon without being shaken.

The anvil 20 has a contact surface 31 of a concavely-curved shape for abutting against the base plate portion 53 of the metal terminal 50, and upon application of a pressing force from the crimper 19, the anvil 20 cooperates with the crimper 19 to press-deform the core wire-crimping piece portions 51 into a predetermined shape.

The ram 18 has a generally rectangular parallelepiped shape. The ram 18 is supported in the ram support portion 27 so as to move upward and downward in the vertical direction. A longitudinal axis of the ram 18 extends in the direction of movement thereof, that is, in the vertical direction. The lower end surface 28 of the ram 18 is flat, and is perpendicular to the direction of movement of the ram 18.

The crimper 19 is provided at a lower half portion of the ram 18 in opposed relation to the anvil 20. The ram 18 is supported in the ram support portion 27 so as to move upward and downward, and therefore the crimper 19 can be brought into and out of engagement with the anvil 20. In other words, the crimper 19 is moved toward and away from the anvil 20 in accordance with the downward and upward movement of the ram 18.

The crimper 19 is in the form of a generally rectangular parallelepiped-shaped plate, and a press-deforming portion 32 of a generally arch-shape is formed at an inner surface of the crimper 19 opposed to the anvil 20. The press-deforming portion 32 is formed into a curved shape or generally arcuate shape so as to press-deform each of the core wire-crimping piece portions 51 of the metal terminal 50 into a C-shape.

The ram bolt 23 is threaded into a threaded hole formed in an upper end surface 33 of the ram 18, and therefore is mounted on the ram 18. By thus mounting the ram bolt 23 on the ram 18, the ram 18 can be moved upward and downward.

The shank 16 has a hollow cylindrical shape. The disk portion formed at one end of the shank 16 is connected to the hook 17 of the drive source 12, and a screw portion formed at the other end of the shank 16 is threaded in a screw hole in the ram bolt 23. Namely, the shank 16 transmits a driving force of the drive source 12 to the ram 18 via the ram bolt 23 so as to move the crimper 19 upward and downward.

The amount of threading of the shank 16 in the screw hole of the ram bolt 23 can be adjusted, and therefore the shank 16 is mounted on the ram bolt 23 in such a manner that the position of the shank 16 relative to the ram bolt 23 can be changed. When the position of the shank 16 relative to the ram bolt 23 is changed by adjusting the amount of threading of the shank 16 in the screw hole of the ram bolt 23, the distance (gap) between the anvil 20 and the crimper 19 is also changed.

The shank 16 has a nut 34 threaded on an externally-threaded portion thereof, and the nut 34 is tightened, with the shank 16 threaded in the screw hole of the ram bolt 23, and by doing so, the ram bolt 23 and the shank 16 can be fixed to each other.

The terminal feed unit 24 includes a cam (not shown) provided at a side portion of the ram 18, a connecting rod (not shown) adapted to abut against the cam to be moved in the horizontal direction, a lever support portion 35 receiving the connecting rod therein, a crank-like lever 36 fitted in the lever support portion 35, a pivot shaft 37 supporting the lever 36 in a manner to allow a pivotal movement of the lever 36, and a terminal feed claw 38 provided at a distal end portion of the lever 36.

In the terminal feed unit 24, the cam is moved downward by the driving force of the drive source 12, and at this time the connecting rod abuts at its one end against the cam, and is pushed to be moved in the horizontal direction, so that the other end portion of the connecting rod is brought into abutting engagement with the lever 36, and the lever 36 is pivotally moved about the pivot shaft 37. As a result, the terminal feed claw 38 is engaged in a feed hole in a chain-like band having a series of metal terminals 50, and feeds this chain-like band in a terminal feeding direction to feed one metal terminal at a time to a crimping position.

In the crimping machine 10, the base plate portion 53 of the metal terminal 50 is placed on the contact surface 31 of the anvil 20, and the core wire 62 of the electric wire 60 is placed on the base plate portion 53.

Then, the ram 18 is moved downward, and therefore the crimper 19 is moved downward relative to the anvil 20. At this time, the press-deforming portion 32 of the crimper 19 strikes against the pair of core wire-crimping piece portions 51 of the metal terminal 50, and therefore the pair of core wire-crimping piece portions 51 are plastically deformed, and are crimped to the core wire (core wire portion) 62 of the electric wire 60 in a stable manner (see FIG. 3).

Figure 4:
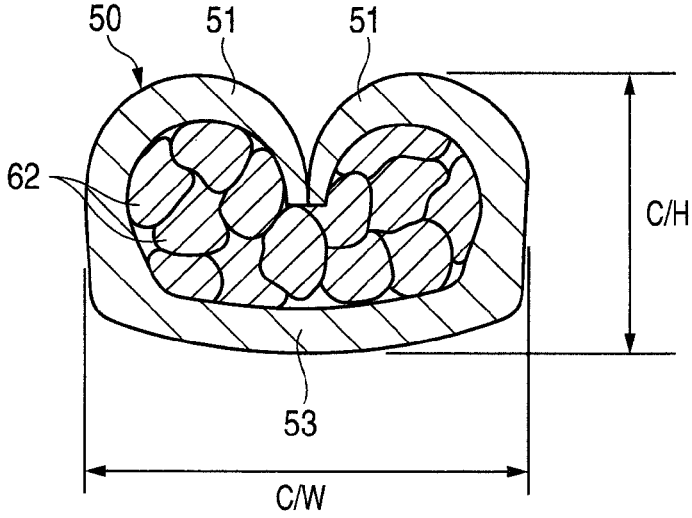
FIG. 4 is a cross-sectional view of the metal terminal of FIG. 3.

As shown in FIG. 4, in the case where the core wire 62 of the electric wire 60 is composed of annealed copper wire elements, the crimping machine 10 is adjusted such that a crimp height (C/H)/a crimp width (C/W) in the compression by the anvil 20 and the crimper 19 is set to around 70%. In the case where the core wire 62 of the electric wire 60 is composed of copper alloy wire elements, the crimping machine 10 is adjusted such that the crimp height (C/H)/the crimp width (C/W) in the compression by the anvil 20 and the crimper 19 is set to around 90%.

Expressing the foregoing in terms of the cross-sectional area of the compressed core wire 62 of the electric wire 60, the compression rate of the copper alloy core wire is determined from the relative relation between parameters varying according to the ratio of (the cross-sectional area of the copper alloy core wire 62 at the crimped portion)/(the cross-sectional area of the copper alloy core wire 62 before crimping) (which is the rate of compression of the copper alloy core wire 62 by the core wire-crimping piece portions 51) and parameters varying according to the ratio of (the cross-sectional area of the annealed copper core wire 62 at the crimped portion)/(the cross-sectional area of the annealed copper core wire 62 before crimping) (which is the rate of compression of the annealed copper core wire 62 by the core wire-crimping piece portions 51), and the metal terminal 50 is crimped to the copper alloy wire (the copper alloy core wire) at the determined compression rate.

At this time, preferably, a wire clamping force varying according to the compression rate of the copper alloy core wire 62 is compared with a wire clamping force varying according to the compression rate of the annealed copper core wire 62, and the compression rate of the copper alloy core wire 62 is determined in such a range that the wire clamping force of the copper alloy wire is larger than the wire clamping force of the annealed copper wire. More specifically, preferably, the metal terminal 50 is crimped to the copper alloy wire in such a manner that the rate of compression of the copper alloy core wire 62 by the core wire-crimping piece portions 51 (which is expressed in terms of the ratio of (the cross-sectional area of the core wire 62 at the crimped portion)/(the cross-sectional area of the core wire 62 before crimping)) is fell in the range of from about 85% to about 95%.

EXAMPLES

Examples carried out in order to confirm advantageous effects of the structure and method of the invention for crimping the terminal to the copper alloy wire will be described below with reference to FIGS. 5 to 10.

(Characteristic Measurement of Processing Strain of Annealed Copper Wire Relative to Compression Rate)

Figure 5:
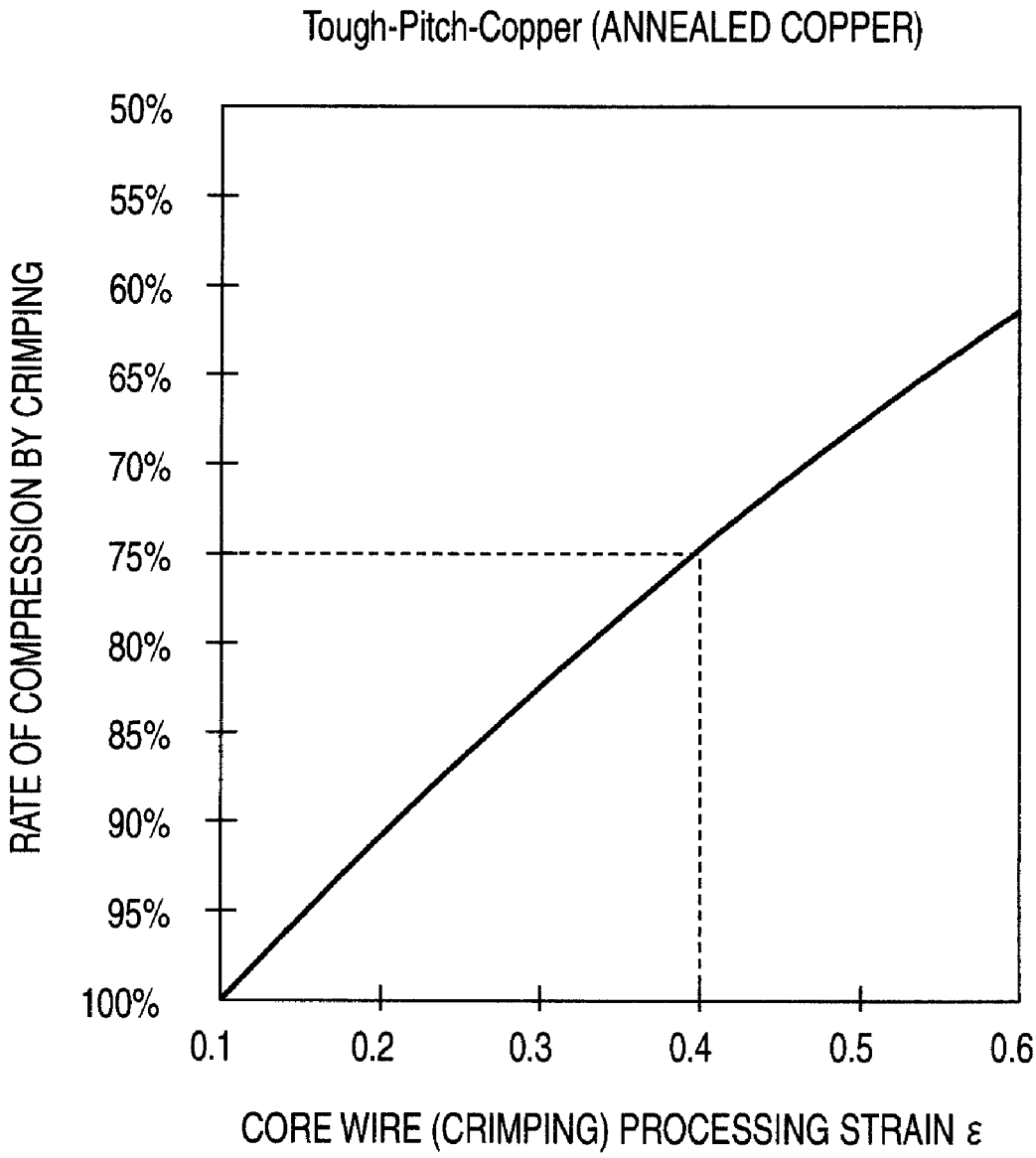
FIG. 5 is a characteristic measurement graph showing a processing strain of an annealed copper core wire (processed in the crimping machine of FIG. 1) relative to a compression rate.

When an electric wire 60 having a core wire 62 composed of annealed copper wire elements was compressed at a compression rate of 100% to 75%, it was found that a value of a processing strain ($\epsilon$) varied from 0.1 to 0.4, that is, a variation was +0.3, as shown in FIG. 5.

(Characteristic Measurement of Tensile Strength of Annealed Copper Wire Relative to Compression Rate)

Figure 6:
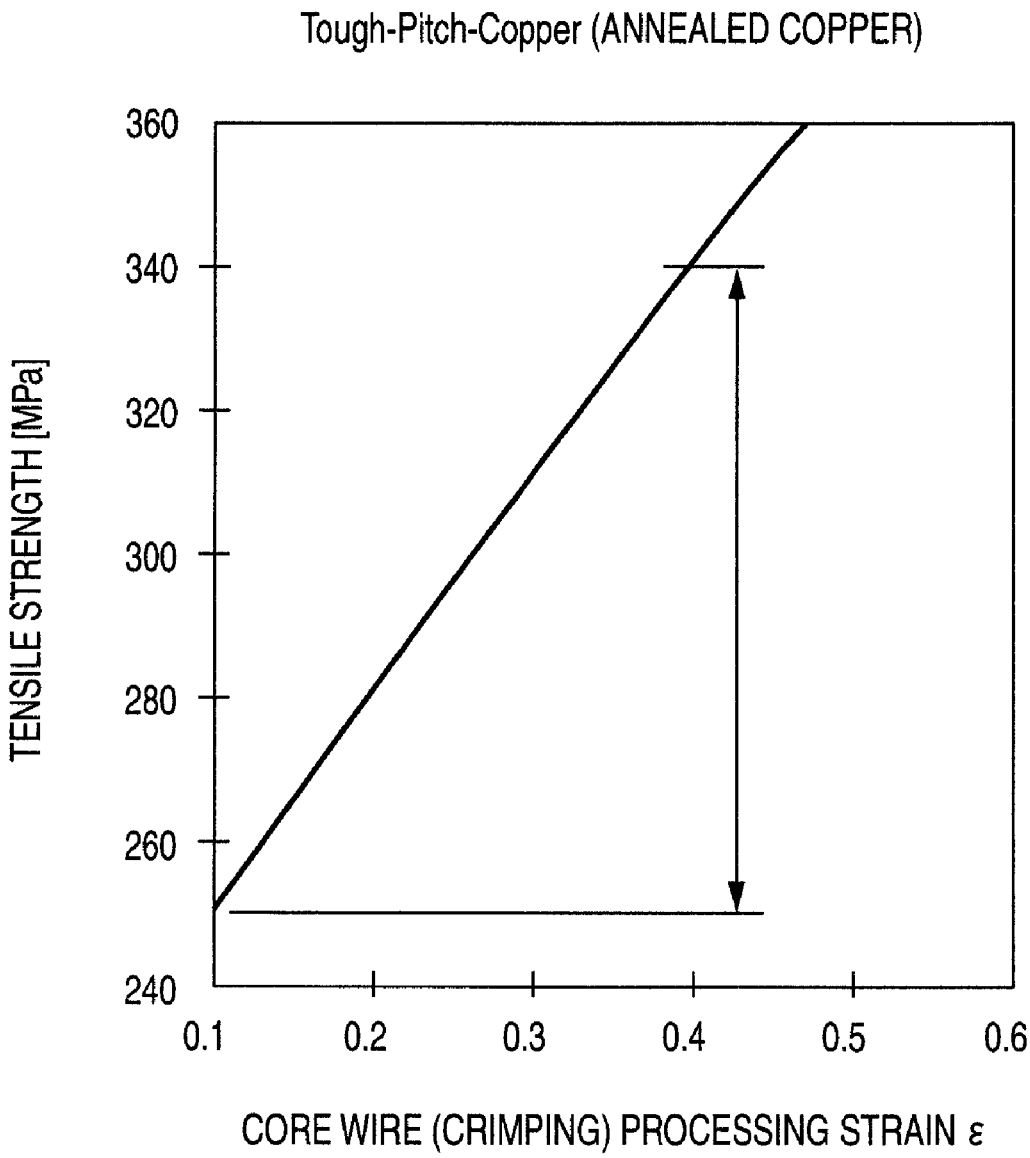
FIG. 6 is a characteristic measurement graph showing a processing strain of an annealed copper core wire (processed in the crimping machine of FIG. 1) relative to a tensile strength.

When an electric wire 60 having a core wire 62 composed of annealed copper wire elements was compressed at a compression rate of 100% to 75%, it was found that a value of a tensile strength (MPa) varied from 250 to 340, that is, a variation was +90, as shown in FIG. 6.

(Characteristic Measurement of Processing Strain of Copper Alloy Wire Relative to Compression Rate)

Figure 7:
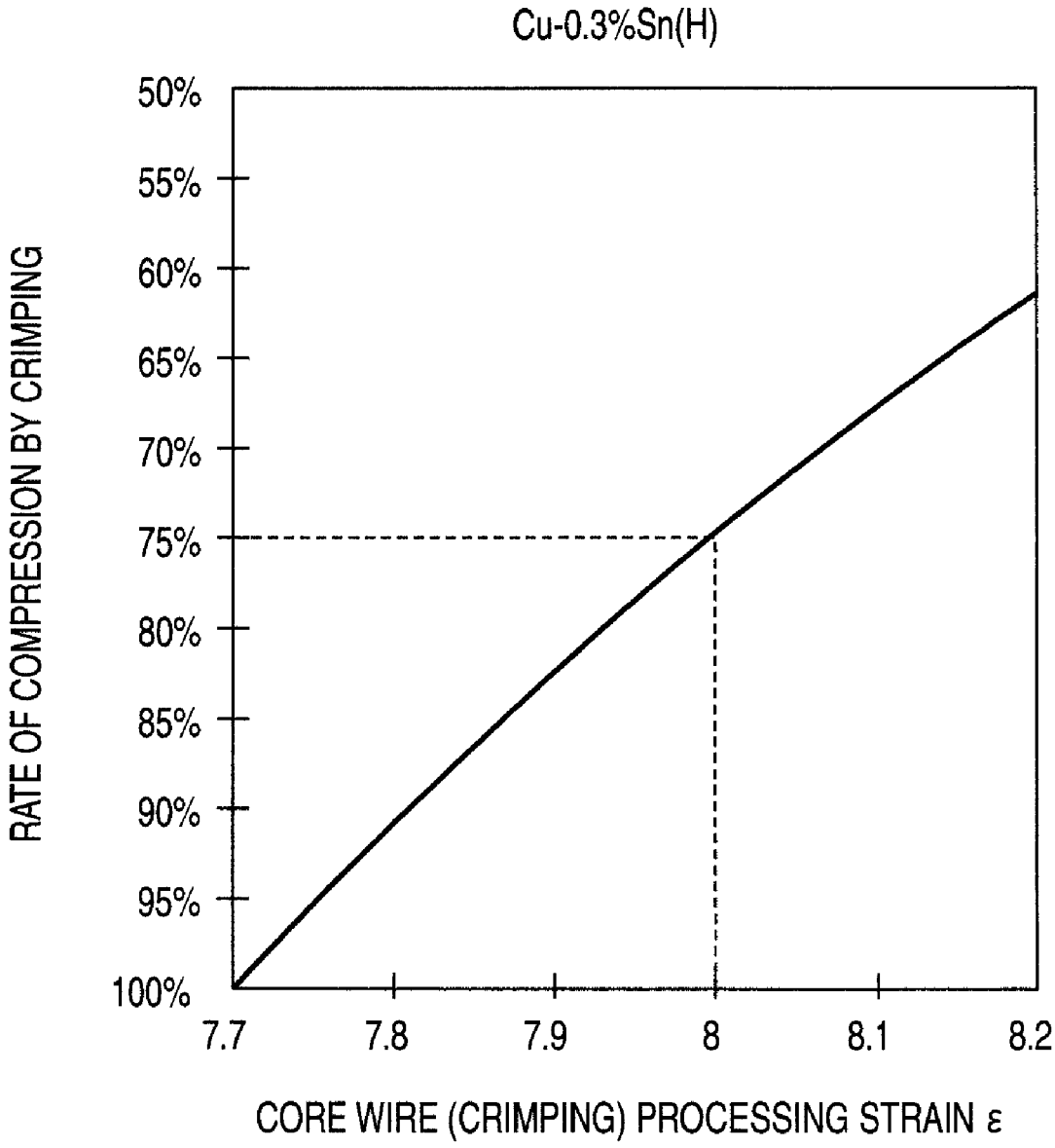
FIG. 7 is a characteristic measurement graph showing a processing strain of a copper alloy core wire (processed in the crimping machine of FIG. 1) relative to a compression rate.

When an electric wire 60 having a core wire 62 composed of copper alloy wire elements was compressed at a compression rate of 100% to 75%, it was found that a value of a processing strain ($\epsilon$) varied from 7.7 to 8.0, that is, a variation was +0.3, as shown in FIG. 7.

(Measurement of Tensile Strength of Copper Alloy Wire Relative to Compression Rate)

Figure 8:
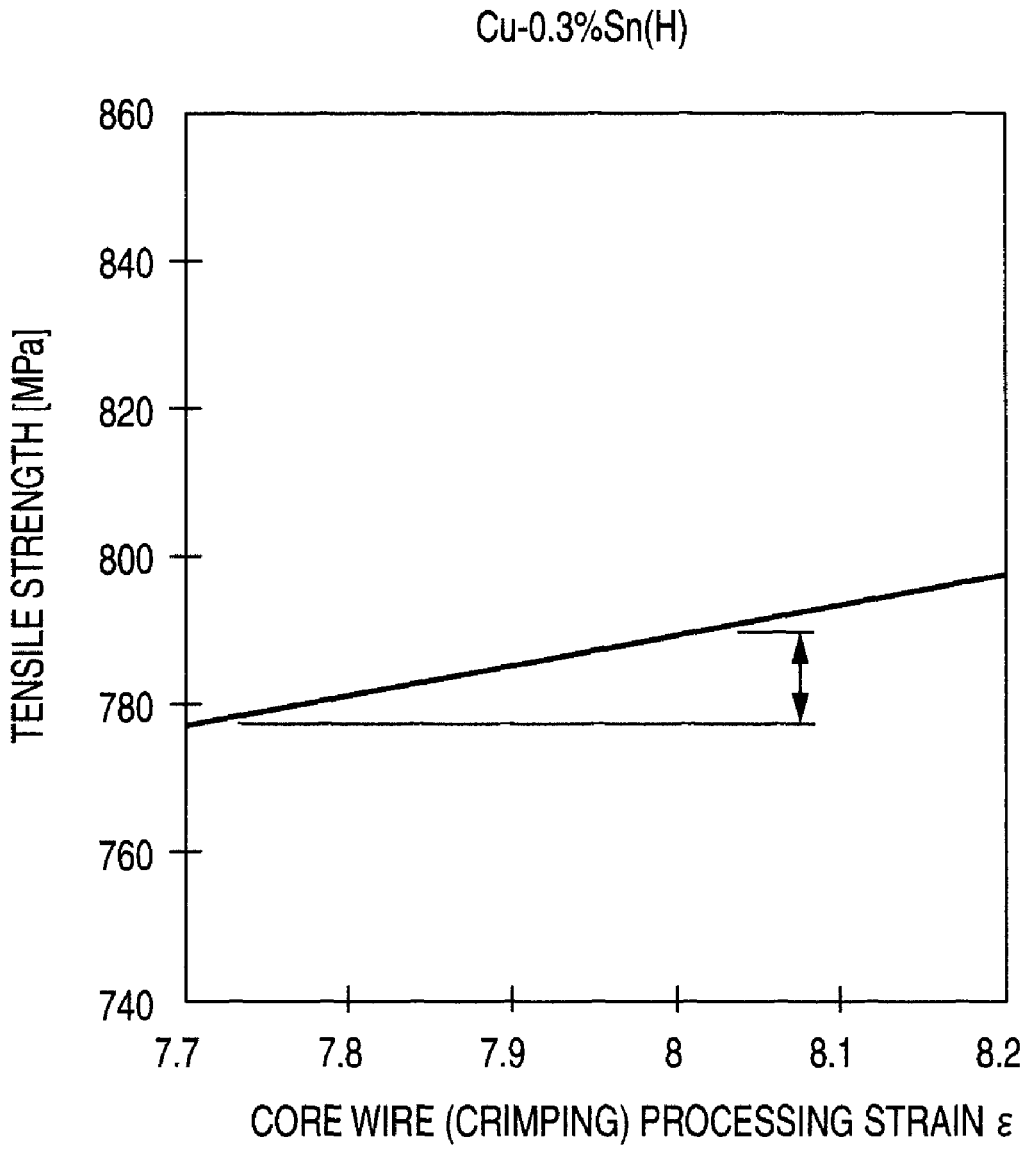
FIG. 8 is a characteristic measurement graph showing a processing strain of a copper alloy core wire (processed in the crimping machine of FIG. 1) relative to a tensile strength.

As shown in FIG. 8, a core wire 62 of an electric wire 60 was composed of copper alloy wire elements each made of a copper alloy containing tin (Sn) (The Sn content: about 0.3%), and the cross-sectional area of the core wire (core wire portion) was 0.13 $mm^2$. Incidentally, the same results were obtained also in the case of an electric wire 60 having a core wire portion having an cross-sectional area of 0.08 $mm^2$. Namely, when the electric wire 60 was compressed at a compression rate of 100% to 75%, it was found that a value of a tensile strength (MPa) varied from 780 to 790, that is, a variation was +10.

(Measurement of Tensile Strength Relative to Rate of Compression of Conductor by Crimping)

Figure 9:
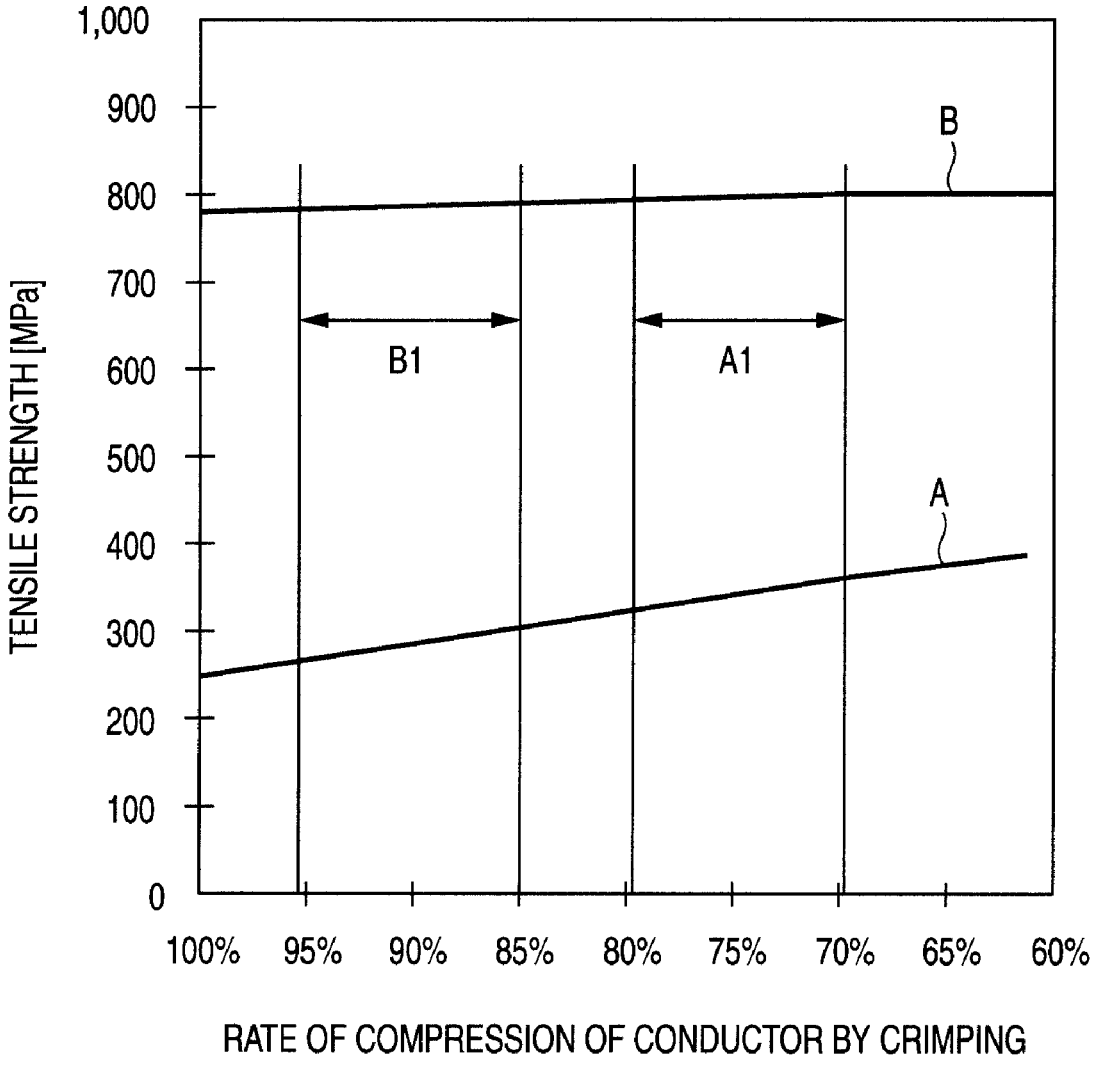
FIG. 9 is a measurement graph showing a tensile strength relative to a rate of compression of a conductor by crimping in the crimping machine of FIG. 1.

In FIG. 9, with respect to a tensile strength relative to the rate of compression of the conductor by crimping, a line A indicates characteristics of an annealed copper wire, and a line B indicates characteristics of a copper alloy wire. In the case where a core wire 62 of an electric wire 60 is composed of annealed copper wire elements, it will be appreciated that a tensile strength per unit area is increased by crimping in the range indicated by A1 in FIG. 9.

In the case where a core wire 62 of an electric wire 60 is composed of copper alloy wire elements, it will be appreciated that a tensile strength per unit area is not so increased by crimping in the range indicated by B1 in FIG. 9.

(Measurement of Clamping Force Relative to Compression Rate of Conductor)

Figure 10:
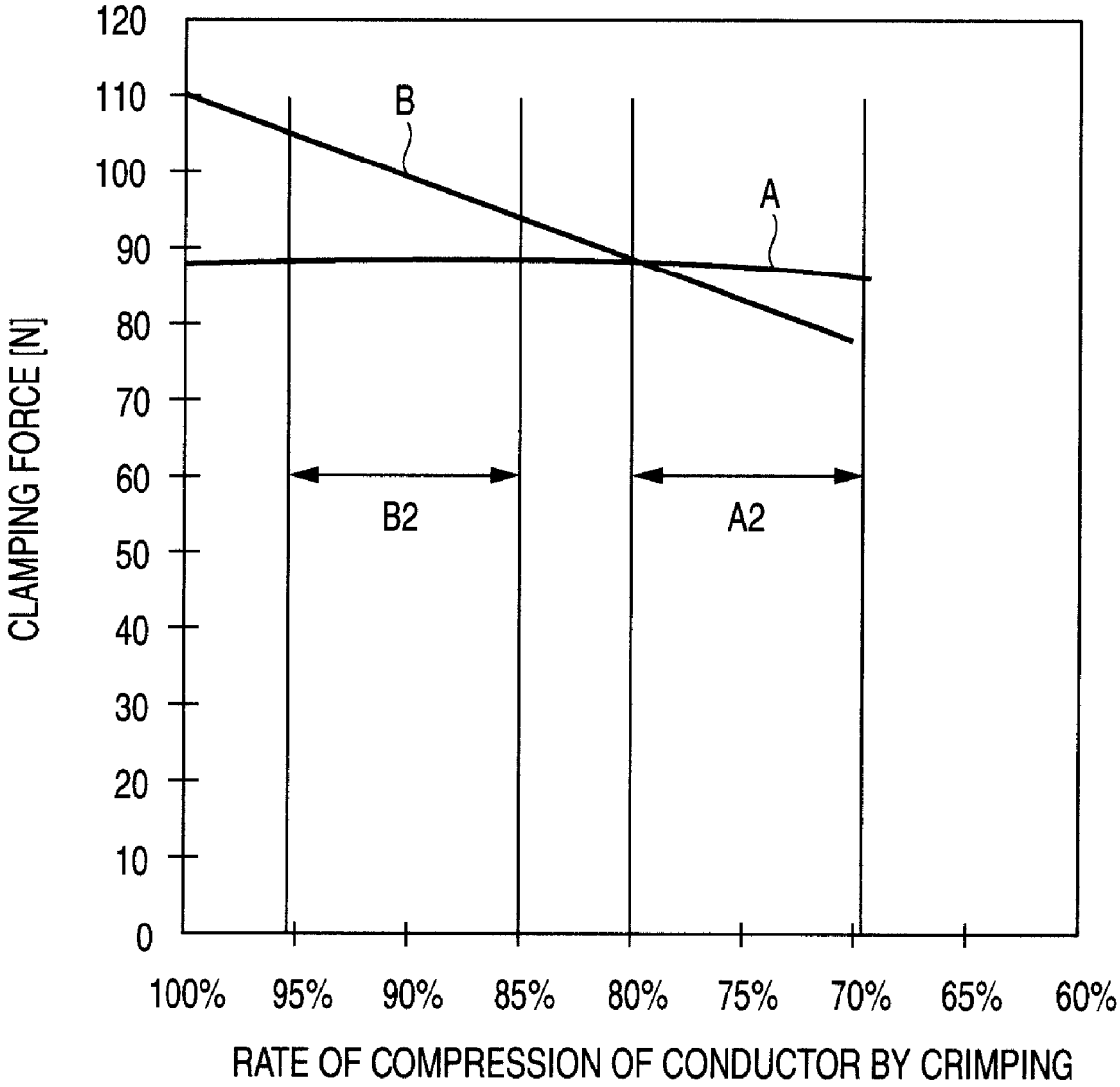
FIG. 10 is a measurement graph showing a clamping force relative to a rate of compression of a conductor by crimping in the crimping machine of FIG. 1.

In FIG. 10, with respect to a clamping force relative to the compression rate of the conductor, a line A indicates characteristics of an annealed copper wire, and a line B indicates characteristics of a copper alloy wire. In the case where a core wire 62 of an electric wire 60 is composed of annealed copper wire elements, it will be appreciated that the decrease of a mechanical strength is small even when the cross-sectional area is reduced by compression. Therefore, an electrical performance is stable. Therefore, in the case of the core wire 62 composed of the annealed copper wire elements, it will be appreciated that the optimum compression rate to be selected should be set to the range A2 of from 70% to 80% which is around 75% of the cross-sectional area.

On the other hand, in the case where a core wire 62 of an electric wire 60 is composed of copper alloy wire elements, it will be appreciated that a mechanical strength decreases with the decrease of the cross-sectional area by compression. Therefore, the copper alloy wire is different in characteristics from the annealed copper wire, and it will be appreciated that the desired mechanical strength can not be obtained with the same standards. Therefore, in the case of the core wire 62 composed of the copper alloy wire elements, it will be appreciated that the optimum compression rate to be selected should be set to the range B2 of from 80% to 95% which is around 90% of the cross-sectional area.

In view of the above results, for crimping the metal terminal 50 to the copper alloy wire, the compression rate of the copper alloy core wire is determined from the relative relation between the parameters varying according to the ratio of (the cross-sectional area of the copper alloy core wire 62 at the crimped portion)/(the cross-sectional area of the copper alloy core wire 62 before crimping) (which is the rate of compression of the copper alloy core wire 62 by the core wire-crimping piece portions 51) and the parameters varying according to the ratio of (the cross-sectional area of the annealed copper core wire 62 at the crimped portion)/(the cross-sectional area of the annealed copper core wire 62 before crimping) (which is the rate of compression of the annealed copper core wire 62 by the core wire-crimping piece portions 51), and the metal terminal 50 is crimped to the copper alloy wire at the determined compression rate.

At this time, preferably, the wire clamping force varying according to the compression rate of the copper alloy core wire 62 is compared with the wire clamping force varying according to the compression rate of the annealed copper core wire 62, and the compression rate of the copper alloy core wire 62 is determined in such a range that the wire clamping force of the copper alloy wire is larger than the wire clamping force of the annealed copper wire. More specifically, preferably, the metal terminal 50 is crimped to the copper alloy wire in such a manner that the rate of compression of the copper alloy core wire 62 by the core wire-crimping piece portions 51, which is expressed in terms of the ratio of (the cross-sectional area of the core wire 62 at the crimped portion)/(the cross-sectional area of the core wire 62 before crimping), is fell in the range of from about 85% to about 95%.

As described above, in the structure of crimping the terminal to the copper alloy wire and also in the wire harness having this terminal crimping structure, the rate of compression of the copper alloy conductor by the core wire-crimping piece portions 51 is the compression rate of the conductor determined from the relative relation between the parameters varying according to the ratio of (the cross-sectional area of the copper alloy wire at the crimped portion)/(the cross-sectional area of the copper alloy wire before crimping) and the parameters varying according to the ratio of (the cross-sectional area of the annealed copper wire at the crimped portion)/(the cross-sectional area of the annealed copper wire before crimping) (which is the rate of compression of the annealed copper wire by the core wire-crimping piece portions 51). At this time, the wire clamping force varying according to the compression rate of the copper alloy wire is compared with the wire clamping force varying according to the compression rate of the annealed copper wire, and the compression rate of the copper alloy wire is determined such that the wire clamping force of the copper alloy wire is larger than the wire clamping force of the annealed copper wire. More specifically, the compression rate of the copper alloy wire, which is expressed in terms of the ratio of (the cross-sectional area of the core wire at the crimped portion)/(the cross-sectional area of the core wire before crimping), is fell in the range of from about 85% to about 95%. Therefore, the process of crimping the metal terminal is carried out at the optimum compression rate determined taking the material and processing of the core wire 62 of the wire 60 into consideration, and therefore the mechanical performance and electrical performance required for the electric wire having the metal terminal crimped to its end portion and also for the wire harness comprising a plurality of such wires can be secured.

In the method of crimping the metal terminal to the copper alloy wire, the compression rate of the copper alloy conductor is determined from the relative relation between the parameters varying according to the ratio of (the cross-sectional area of the copper alloy wire at the crimped portion)/(the cross-sectional area of the copper alloy wire before crimping) (which is the rate of compression of the copper alloy conductor by the core wire-crimping piece portions 51) and the parameters varying according to the ratio of (the cross-sectional area of the annealed copper wire at the crimped portion)/(the cross-sectional area of the annealed copper wire before crimping) (which is the rate of compression of the annealed copper core wire 62 by the core wire-crimping piece portions 51), and the metal terminal 50 is crimped to the copper alloy wire at the determined compression rate. At this time, the wire clamping force varying according to the compression rate of the copper alloy core wire 62 is compared with the wire clamping force varying according to the compression rate of the annealed copper core wire 62, and the compression rate of the copper alloy wire is determined such that the wire clamping force of the copper alloy wire is larger than the wire clamping force of the annealed copper wire. More specifically, the metal terminal 50 is crimped to the copper alloy wire in such a manner that the rate of compression of the copper alloy wire by the core wire-crimping piece portions 51, which is expressed in terms of the ratio of (the cross-sectional area of the core wire at the crimped portion)/(the cross-sectional area of the core wire before crimping), is fell in the range of from about 85% to about 95%. Therefore, the process of crimping the metal terminal is carried out at the optimum compression rate determined taking the material and processing of the core wire 62 of the wire 60 into consideration, and therefore the mechanical performance and electrical performance required for the electric wire having the metal terminal crimped to its end portion and also for the wire harness comprising a plurality of such wires can be secured.

The present invention is not limited to the above embodiment, and various modifications, improvements, etc., can be suitably made. Furthermore, the material, shape, dimensions, numerical value, form, number, disposition, etc., of each of the constituent elements of the above embodiment are arbitrary, and are not limited in so far as the invention can be achieved.

For example, the number of the core wire elements is not limited to the illustrated number in the above embodiment, and can be suitably determined according to a capacity of a circuit to which the electric wire is applied.

The present application is based on Japan Patent Application No. 2007-013058 filed on Jan. 23, 2007, the contents of which are incorporated herein for reference.

What is claimed is:

1. A terminal crimping structure, comprising:

a terminal that is crimped to a copper alloy wire of an electric wire which has a copper alloy core wire portion composed of a copper alloy wire element and a sheath portion covering the copper alloy core wire portion, wherein the terminal has a crimping piece portion crimped to the copper alloy core wire portion;

wherein in the case where a cross-sectional area of the copper alloy core wire portion is 0.08 $mm^2$ to 0.13 $mm^2$, a rate of compression of the copper alloy core wire portion by the crimping piece portion is determined from a relative relation between a parameter varying according to the ratio of (the cross-sectional area of the copper alloy core wire portion at a crimped portion)/(the cross-sectional area of the copper alloy core wire portion before crimping) and a parameter varying according to the ratio of (a cross-sectional area of an annealed copper core wire portion at a crimped portion)/the cross-sectional area of the annealed copper core wire portion before crimping) which is the rate of compression of the annealed copper core wire portion by the crimping piece portion.

2. The terminal crimping structure according to claim 1, wherein the rate of compression of the copper alloy core wire portion is determined such that a wire clamping force of the copper alloy wire varying according to the compression rate of the copper alloy core wire portion is greater than a wire clamping force of the annealed copper wire varying according to the compression rate of the annealed copper core wire portion.

3. A terminal crimping structure, comprising:

a terminal that is crimped to a copper alloy wire of an electric wire which has a copper alloy core wire portion composed of a copper alloy wire element and a sheath portion covering the copper alloy core wire portion, wherein the terminal has a crimping piece portion crimped to the copper alloy core wire portion;

wherein in the case where a cross-sectional area of the copper alloy core wire portion is 0.08 $mm^2$ to 0.13 $mm^2$, a rate of compression of the copper alloy core wire portion by the crimping piece portion is in a range of from about 85% to about 95%; and wherein the rate of compression of the copper alloy core wire portion by the crimping piece portion is expressed as a ratio of (the cross-sectional area of the copper alloy core wire portion at a crimped portion)/(the cross-sectional area of the copper alloy core wire portion before crimping).

4. A wire harness, comprising:

an electric wire that has a copper alloy core wire portion composed of a copper alloy wire element and a sheath portion covering the copper alloy core wire portion; and a terminal that is crimped to a copper alloy core wire of the electric wire, wherein the terminal has a crimping piece portion crimped to the copper alloy core wire portion;

wherein in the case where a cross-sectional area of the copper alloy core wire portion is 0.08 $mm^2$ to 0.13 $mm^2$, a compression rate of the copper alloy wire portion by the crimping piece portion is in the range of from about 85% to about 95%; and wherein a rate of compression of the copper alloy core wire portion by the crimping piece portion is expressed as a ratio of (the cross-sectional area of the copper alloy core wire portion at a crimped portion)/(the cross-sectional area of the copper alloy core wire portion before crimping).

* * * * *